US007818204B2

(12) United States Patent
Solomon

(10) Patent No.: US 7,818,204 B2
(45) Date of Patent: Oct. 19, 2010

(54) TRAFFIC CONTROL SYSTEM WITH ROAD TARIFF DEPENDING ON THE CONGESTION LEVEL

(75) Inventor: Lawrence Solomon, Toronto (CA)

(73) Assignee: P.E.M.A. Preserving the Environment Matters Association, Toronto, Ontario (CA)

( * ) Notice: Subject to any disclaimer, the term of this patent is extended or adjusted under 35 U.S.C. 154(b) by 1597 days.

(21) Appl. No.: 10/469,905

(22) PCT Filed: Mar. 7, 2002

(86) PCT No.: PCT/CA02/00297

§ 371 (c)(1),
(2), (4) Date: Jan. 22, 2004

(87) PCT Pub. No.: WO02/071338

PCT Pub. Date: Sep. 12, 2002

(65) Prior Publication Data

US 2004/0119609 A1 Jun. 24, 2004

(30) Foreign Application Priority Data

Mar. 7, 2001 (CA) ..... 2339433

(51) Int. Cl.
*G07B 15/00* (2006.01)
*G07B 15/02* (2006.01)

(52) U.S. Cl. ..... 705/13; 340/905; 340/603; 701/117

(58) Field of Classification Search ..... 705/13, 705/417, 1; 340/95, 603; 703/6
See application file for complete search history.

(56) References Cited

U.S. PATENT DOCUMENTS 5,289,183 A * 2/1994 Hassett et al. ..... 340/905
5,617,086 A * 4/1997 Klashinsky et al. ..... 340/907

(Continued)

FOREIGN PATENT DOCUMENTS

CA 2340137 8/1998

(Continued)

OTHER PUBLICATIONS

"UK: Car Bans to be Imposed in City-Centers," Published by Sunday Times, Nov. 30, 1997.*

(Continued)

*Primary Examiner*—John W Hayes
*Assistant Examiner*—Brian Epstein
(74) *Attorney, Agent, or Firm*—Ohlandt, Greeley, Ruggiero & Perle, L.L.P.

(57) ABSTRACT

A vehicular traffic control server includes monitoring means, tariff adjusting means in communication with the monitoring means, and notifying means in communication with the tariff adjusting means. The monitoring means is configured to monitor at least one traffic congestion parameter of a roadway having a road tariff. The tariff adjusting means is configured to adjust the road tariff in accordance with the monitored traffic congestion parameter. The notifying means is configured to notify at least one motorist of the adjusted road tariff.

10 Claims, 4 Drawing Sheets

U.S. PATENT DOCUMENTS

| | | | | | |
|---|---|---|---|---|---|
| 5,694,322 | A | * | 12/1997 | Westerlage et al. | 705/417 |
| 5,831,876 | A | * | 11/1998 | Orr et al. | 703/6 |
| 5,864,831 | A | * | 1/1999 | Schuessler | 705/417 |
| 5,928,291 | A | | 7/1999 | Jenkins et al. | 701/1 |
| 5,970,481 | A | | 10/1999 | Westerlage et al. | 705/417 |
| 5,991,689 | A | | 11/1999 | Aito et al. | 701/209 |
| 6,011,515 | A | * | 1/2000 | Radcliffe et al. | 342/453 |
| 6,104,299 | A | * | 8/2000 | Brusseaux et al. | 340/603 |
| 6,236,933 | B1 | | 5/2001 | Lang | 701/117 |
| 6,253,146 | B1 | | 6/2001 | Hanson et al. | 701/202 |
| 6,269,303 | B1 | | 7/2001 | Watanabe et al. | 701/209 |
| 6,278,935 | B1 | | 8/2001 | Kaplan et al. | 701/200 |
| 6,301,533 | B1 | | 10/2001 | Markow | 701/35 |
| 6,505,114 | B2 | * | 1/2003 | Luciani | 701/117 |
| 2002/0072963 | A1 | * | 6/2002 | Jonge | 705/13 |
| 2003/0110075 | A1 | * | 6/2003 | Shioda et al. | 705/13 |
| 2008/0065568 | A1 | * | 3/2008 | Dawson et al. | 705/400 |

FOREIGN PATENT DOCUMENTS

| | | | | |
|---|---|---|---|---|
| CA | 2266208 | | | 3/1999 |
| CA | 2 364 315 | A1 | | 9/2000 |
| CN | 1196131 | A | | 10/1998 |
| DE | 4446663 | | | 12/1994 |
| DE | 44 46 663 | A1 | | 6/1996 |
| DE | 19634340 | | | 8/1996 |
| DE | 196 34 340 | A1 | | 2/1998 |
| EP | 1 050 853 | A1 | | 11/2000 |
| JP | 8096181 | | | 4/1996 |
| JP | 08096181 | | * | 4/1996 |
| JP | 2000-17890 | | * | 6/2000 |
| JP | 200172892 | | | 6/2000 |
| JP | 2000-331205 | | | 10/2000 |
| JP | 2001034796 | | | 2/2001 |
| JP | 2000067288 | | | 3/2001 |
| WO | WO 95/20748 | | | 1/1995 |
| WO | WO 98/30990 | | | 1/1998 |
| WO | WO 98/05005 | | | 2/1998 |
| WO | WO0054240 (A1) | | | 9/2000 |

OTHER PUBLICATIONS

Dr. E. Korolkiewicz and Mr. C. Maddison, "*Congestion Monitoring System*", pp. 361-367, Published Sep. 2, 1992.

Lawrence Solomon, "*Revolution on the Roads*", parts 1 and 2, Jun. 1, 1996, pp. 1-5.

* cited by examiner

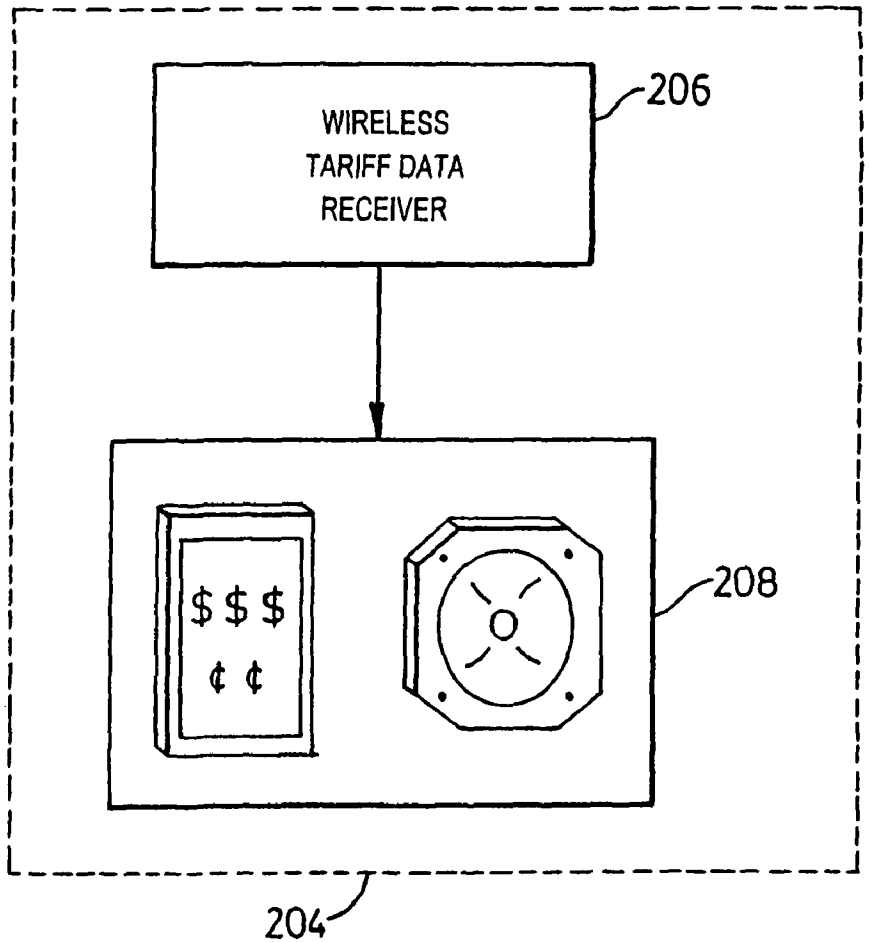
FIG. 2
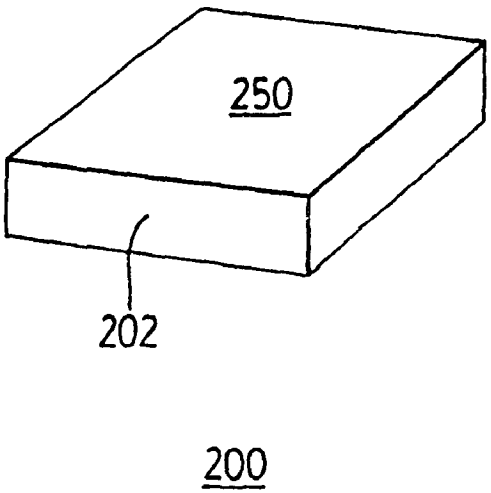

TRAFFIC CONTROL SYSTEM WITH ROAD TARIFF DEPENDING ON THE CONGESTION LEVEL

CROSS-REFERENCE TO RELATED APPLICATIONS

The present application is a national stage entry of International Application No. PCT/CA02/00297, filed Mar. 7, 2002, which in turn claims priority of Canadian Patent Application No. 2,339,433, filed Mar. 7, 2001.

FIELD OF THE INVENTION

The present invention relates to a traffic control system. In particular, the present invention relates to a method and a system for influencing vehicular traffic on public roads employing road tariffs or tolls.

BACKGROUND OF THE INVENTION

The continuous increase in human population density and urban sprawl, has brought with it a steady increase in vehicular traffic volume as more commuters are forced to travel more often and over longer distances on public roads highways to reach their intended destinations. As traffic volume has increased, traffic congestion has also increased thereby leading to an increase in fuel consumption and road wear and a drop in air quality. Accordingly, municipalities and governments have attempted to reduce traffic congestion as a means to reduce vehicle operating costs, road maintenance costs, and air pollution.

The most common approach for reducing traffic congestion has been to use traffic signal lights installed at the intersection of roadways. Typically, the traffic signals use sensors concealed under the road surface in order to monitor and control traffic flow through the intersections. Another approach has been to use traffic cameras and electronic billboards to notify motorists of road conditions and any automobile accidents which may impede traffic flow. An additional approach has been to develop alternate or parallel traffic routes extending between common points. Although these approaches have been widely adopted, they have been ineffective at reducing traffic congestion on a macroscopic level.

For instance, traffic signals are useful when employed on municipal roadways, but cannot be used to control traffic throughput on highways due to the relatively insignificant number of intersections. Typically, traffic cameras must be monitored by human operators, thereby introducing a delay between the recognition of a traffic problem and the notification thereof to the appropriate motorists. Also, billboards typically can only suggest that motorists select a single alternate route when a traffic problem develops on one route. As a result, notification of a traffic problem on one route often causes a traffic problem on the suggested alternate route. The construction of additional parallel traffic routes is limited by budget limitations of the municipality or government. Although road tariffs or tolls can be used as a means to fund the construction of such routes, commuters are often reluctant to use toll routes when non-toll routes are readily available.

Consequently, there have been many attempts to address the problem of traffic congestion, however the solution to this problem to-date remains largely unsolved.

SUMMARY OF THE INVENTION

According to the present invention, there is provided a mechanism for influencing vehicular traffic via a variable road tariff.

In accordance with one aspect of the invention, there is provided a method for influencing vehicular traffic which includes the steps of (1) monitoring at least one traffic congestion parameter of a roadway having a road tariff; (2) adjusting the road tariff in accordance with the monitored traffic congestion parameter; and (3) notifying at least one motorist of the adjusted road tariff.

In accordance with another aspect of the invention, there is provided a vehicular traffic control server which includes monitoring means, tariff adjusting means in communication with the monitoring means, and notifying means in communication with the tariff adjusting means. The monitoring means is configured to monitor at least one traffic congestion parameter of a roadway having a road tariff. The tariff adjusting means is configured to adjust the road tariff in accordance with the monitored traffic congestion parameter. The notifying means is configured to notify at least one motorist of the adjusted road tariff.

According to one implementation of the invention, the roadway includes a number of road segments, and at least one of the road segments includes an air quality sensor disposed for measuring air quality in proximity to the associated road segment. Preferably, each motorist is provided with position identification means for providing the notifying means with position data identifying a current position thereof, and the monitoring means comprises a sensor receiver configured for receiving the air quality measurements, and a position receiver configured for determining traffic volume for each road segment from the position data.

The tariff adjusting means comprises a tariff database of tariff data records, with each tariff data record being associated with a respective segment of the roadway and identifying the associated road tariff. The tariff adjusting means is configured to adjust the road tariff in each tariff data record from the associated determined traffic volume and the associated air quality measurement. The notifying means is configured to receive an indication of the motorist's current position, and to provide the motorist with an indication of the adjusted road tariff based on the motorist position) indication. Upon receipt of the road tariff information, the motorist is able to make a decision to proceed along the toll route or proceed along an alternate route. Consequently, to the extent that motorists are influenced by toll rates, the traffic control server is able to control vehicular congestion.

As used in this specification, the word "comprising" should not be construed in a limiting sense, but instead should be construed in an expansive sense as being synonymous with the word "including".

BRIEF DESCRIPTION OF THE DRAWINGS

The present invention will now be described, by way of example only, with reference to the drawings, in which:

FIG. 2 is a schematic view of a wireless transponding positioning transceiver which comprises a component in one implementation of the wireless position identification system;

DETAILED DESCRIPTION OF THE PREFERRED EMBODIMENT

Figure 1:
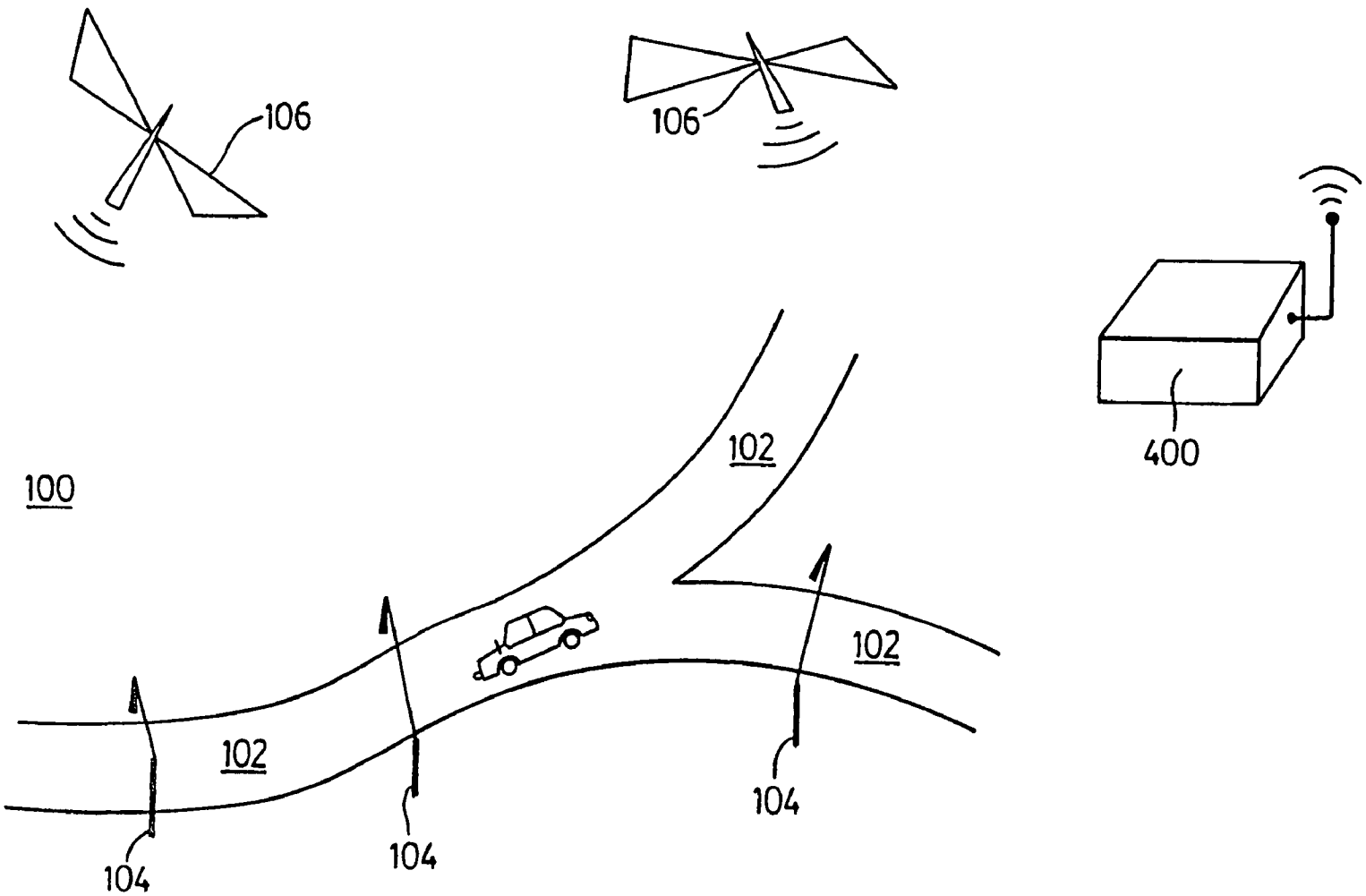
FIG. 1 is a schematic view of a vehicular traffic influencing system, according to the present invention, depicting the road segments, the wireless position identification system the air quality sensors, and the traffic control server.

FIG. 1 is a schematic representation of a vehicular traffic influencing system which influences vehicular traffic via a variable road tariff. The vehicular traffic influencing system, denoted generally as 100, is shown comprising a roadway having a plurality of road segments 102 traveled by a plurality of motor vehicles, a position identification system, and a traffic control server 400 in communication with the position identification system. In addition to the position identification system, the vehicular traffic influencing system 100 optionally includes one or more air quality sensors (not shown) in communication with the traffic control server 400. The air quality sensors are disposed in proximity to each of the road segments 102 along the length of each road segment 102, and monitor the air quality along each respective road segment 102.

The position identification system is configured to provide the traffic control server 400 with location data identifying the location of each of the vehicles on the roadway. In one implementation, the position identification system comprises a plurality of wireless transponding positioning transceivers 200 (FIG. 2), and a plurality of wireless transponder transceivers 104. Each of the motor vehicles is fitted with one of the wireless transponding positioning transceivers 200, and the road segments 102 include a transponder transceiver 104 disposed in advance of the entrance to the associated road segment 102 for communicating with the wireless transponding positioning transceivers 200 immediately prior to the vehicle entering the road segment 102. In addition, preferably each road segment 102 includes a number of transponder transceivers 104 disposed periodically along the length of the road segment 102 to allow the traffic control server 400 to monitor traffic flow along each road segment 102.

As shown in FIG. 2, the wireless transponding positioning transceivers 200 comprises a wireless transponder unit 202 and a wireless tariff receiver 204 (preferably disposed within a common housing). Each wireless transponder 202 is assigned a transponder identification code 250 uniquely associated with the wireless transponder, and is configured to provide the transponder transceivers 104 with the assigned identification code 250 when the wireless transponding positioning transceiver 200 is in proximity to one of the transponder transceivers 104. Each transponder transceiver 104 is assigned a transceiver identification code 260 and is configured to transmit to the traffic control server 400 a data packet including the transponder identification code 250 and the transceiver identification code 260 to thereby allow the traffic control server 400 to determine the location of the associated motor vehicle along the roadway. Wireless transponders 202 and transponder transceivers 104 are well known to those skilled in the art and, therefore, need not be described in further detail.

The wireless tariff receiver 204 includes a wireless tariff data receiver 206, and a tariff data output 208 coupled to the tariff data receiver 206. The wireless tariff receiver 204 is assigned a receiver identification code which matches the transponder identification code 250, and uses the tariff data receiver 206 to receive from the traffic control server 400 wireless road tariff data identifying the road tariff in effect for the upcoming road segment 102. The tariff data output 208 typically comprises a LCD display and/or a speaker, and provides the vehicle occupant with a visual and/or audible indication of the road tariff for the upcoming road segment 102. The wireless tariff receiver 204 is configured to recognize data packets received by the tariff data receiver 206 which include an identification code which matches the transponder identification code 250, and to ignore data packets containing a different identification code.

Figure 3:
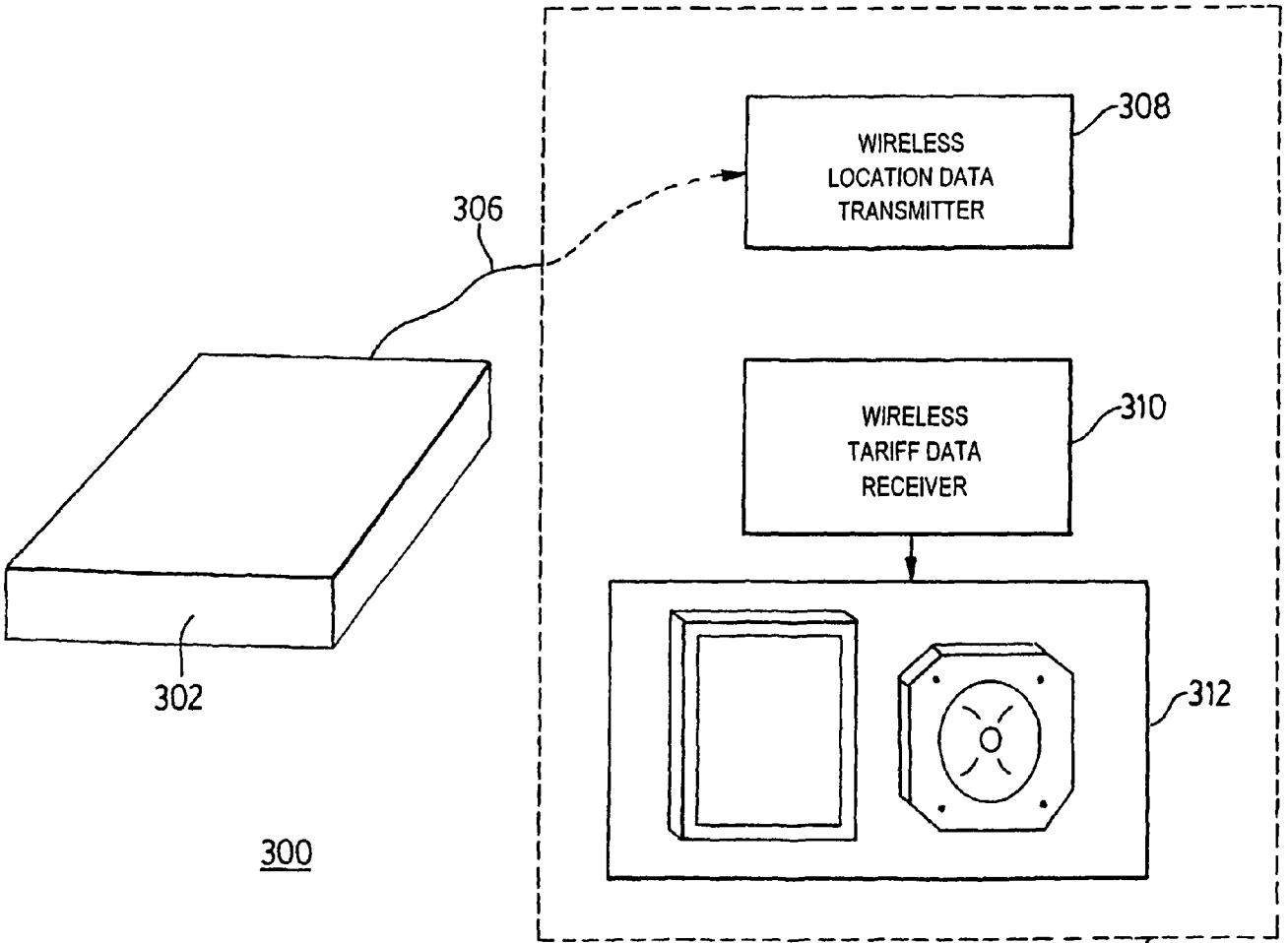
FIG. 3 is a schematic view of a wireless GPS positioning transceiver which comprises a component in another implementation of the wireless position identification system.

Alternately, in another implementation, the position identification system comprises a plurality of wireless GPS positioning transceivers 300, and a plurality of Global Positioning System (GPS) satellites 106. Each of the motor vehicles is fitted with one of the wireless GPS positioning transceivers 300, and the GPS satellites 106 are in orbit above the roadway. As shown in FIG. 3, the wireless GPS positioning transceiver 300 comprises a GPS receiver 302 and a wireless tariff transceiver 3041 in communication with the GPS receiver 302. For convenience, preferably the GPS receiver 302 and the wireless tariff transceiver 304 are located in a common) housing. The GPS receiver 302 is configured to communicate with the GPS satellites 106 and to provide the wireless tariff transceiver 304 with location data identifying the location of the motor vehicle. OPS satellites 106 and GPS receivers 302 are well know to those skilled in the art and, therefore, need not be described in further detail.

The wireless tariff transceiver 304 includes a location data input 306, a location data transmitter 30B coupled to the location data input 306, a wireless tariff data receiver 310, and a wireless tariff data output 312 coupled to the tariff data receiver 310. The wireless tariff transceiver 304 is assigned a GPS transceiver identification code 350 which is uniquely associated with the wireless tariff transceiver 304, and uses the location data input 306 to receive from the GPS receiver 302 location data identifying the location of the wireless GPS positioning transceiver 300. The location data transmitter 308 is configured to periodically transmit to the traffic control server 400 a wireless data packet including the GPS transceiver identification code 350 and the location of the wireless tariff transceiver 304. The wireless tariff transceiver 304 uses the tariff data receiver 310 to receive from the traffic control server 400 wireless road tariff data identifying the road tariff in effect for the upcoming road segment 102. The tariff data output 312 typically comprises a LCD display and/or a speaker, and provides the vehicle occupant with a visual and/or audible indication of the road tariff for the upcoming road segment 102. The wireless tariff transceiver 304 is configured to recognize data packets received by the tariff data receiver 310 which include an identification code which matches the GPS transceiver identification code 350, and to ignore data packets containing a different identification code.

Although the use of wireless GPS positioning transceivers 300 has been described as being an alternative to the use of wireless transponding positioning transceivers 200, it should be understood that a motor vehicle can include either a wireless GPS positioning transceiver 300 or a wireless transponding positioning transceiver 200, in which case the position identification system should include both GPS satellites 106 and transponder transceivers 104 to allow the traffic control server 400 to monitor the traffic flow independently of the signaling device (wireless GPS positioning transceiver 300 or wireless transponding positioning transceiver 200) installed in the vehicle. Further, it should be understood that a motor vehicle can be fitted with both forms of signaling devices for redundancy purposes.

Figure 4:
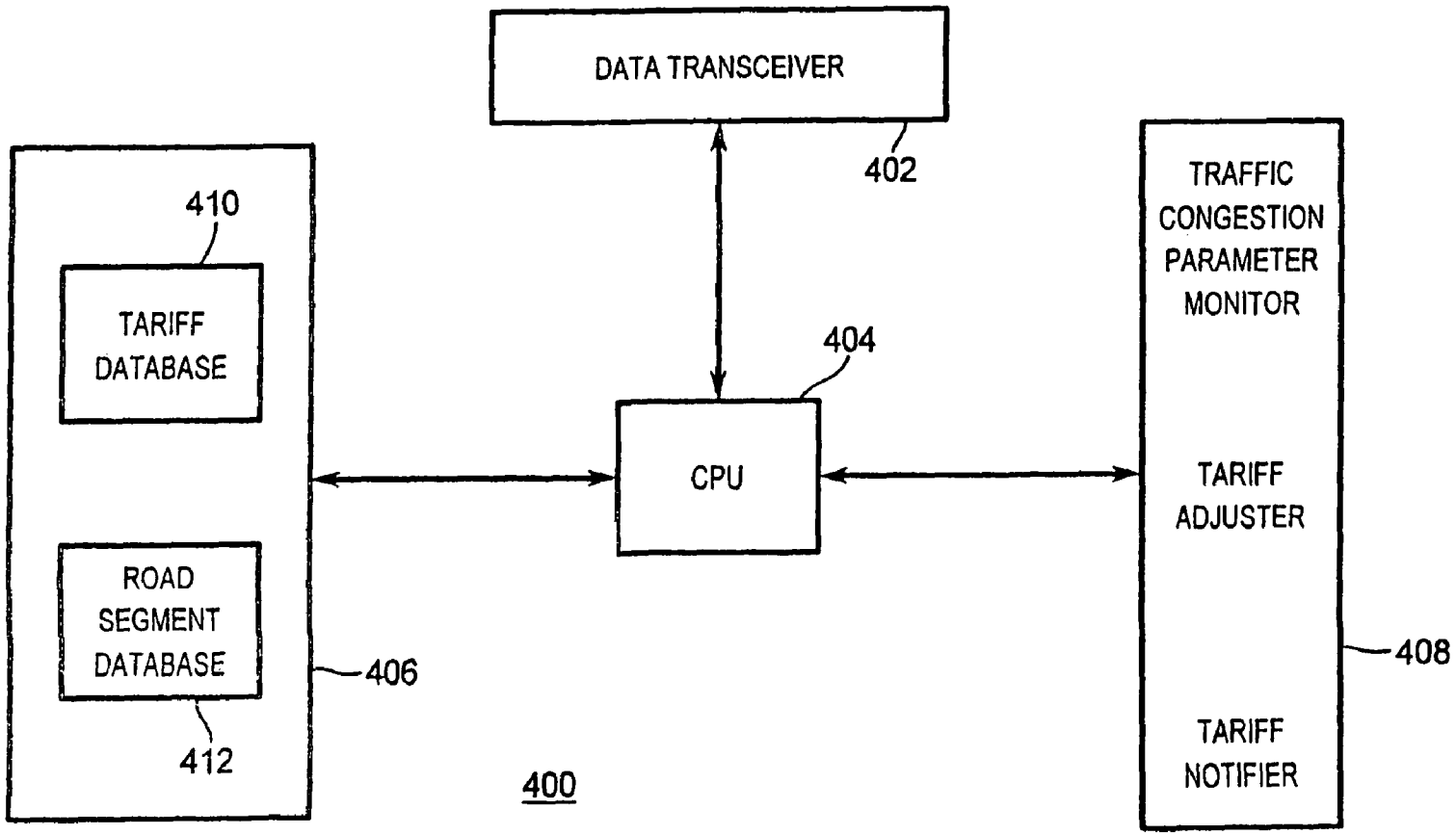
FIG. 4 is a schematic view of traffic control server.

The traffic control server 400 is shown in FIG. 4. The traffic control server 400 is implemented as a computer server, and is in communication with a municipal billing server (not shown) which can issue invoices to motorists for traveling upon the roadway. The traffic control server 400 includes a data transceiver 402, a central processing unit 404 (CPU) in communication with the data transceiver 402, a non-volatile memory 406 (TOM) and a volatile memory 408 (RAM) in communication with the CPU 404. The ROM 406 may be implemented as any of a non-volatile read/write electronic memory, an optical storage device and a read/write magnetic storage device.

The data transceiver 402 includes a wireless transmitter configured to transmit tariff data to the motor vehicles. In addition, the data transceiver 402 is configured to receive from the position identification system the identification codes to be used to identify the location of the vehicles on the roadway. Accordingly, in the implementation where the position identification system comprises a plurality of wireless transponding positioning transceivers 200 and a plurality of wireless transponder transceivers 104, the data transceiver 402 includes a wired data transceiver coupled to the transponder transceivers 104 through suitable cabling, and is configured to receive from the transponder transceivers 104 transponder identification codes 250 for vehicles which have passed one of the transponder transceivers 104, and transceiver identification codes 260 for those wireless transponding positioning transceivers 200. In the implementation where the position identification system comprises a plurality of wireless GPS positioning transceivers 300 and a plurality of GPS satellites 106, the data transceiver 402 includes a wireless data transceiver, and is configured to receive from each wireless GPS positioning transceiver 300 the associated GPS transceiver identification code 350 and location data. As will be apparent, the data transceiver 402 may also be configured to receive information from both transponder transceivers 104 and wireless GPS positioning transceivers 300 for added flexibility and/or redundancy.

As discussed above, the vehicular traffic influencing system 100 may include one or more air quality sensors. In this variation, the data transceiver 402 is coupled to the air quality sensors through suitable cabling, and is configured to receive from the air quality sensors air quality data identifying the air quality at each road segment 102. Preferably, each air quality sensor is connected to a respective input port of the data transceiver 402 to thereby identify the air quality sensor and the road segment 102 associated with the air quality data. Typically the air quality sensors measure air pollution, however the air quality sensors can also be selected to measure other air quality parameters such as velocity, humidity, temperature and ozone.

The ROM 406 maintains a tariff database 410 and a road segment database 412. The tariff database 410 includes a number of tariff data records, with each tariff data record being associated with a respective road segment 102 and identifying a road segment D for the road segment 102, and the current road tariff for the associated road segment 102. The road segment database 412 includes a number of road segment records, with each road segment record being associated with a respective road segment 102 and including a road segment ID for the road segment 102, location data identifying the location (eg. range of longitude and latitude between the start and end of the road segment 102) of the road segment 102, and the road segment D for the next or upcoming road segment(s). In this manner, when the traffic control server 400 determines the location of a motor vehicle on a road segment 102, the traffic control server 400 is able to identify the road segment(s) which the motor vehicle can take should the vehicle continue on in its direction of travel, and is thereby able to provide the motor vehicle operator with tariff information for each possible route. As will be apparent, to do so each road segment ID for a road segment 102 in the tariff database 410 should match the road segment ID for the same road segment 102 in the road segment database 412.

For the implementation where the position identification system includes both wireless transponding positioning transceivers 200 and wireless GPS positioning transceivers 300, each road segment record also identifies the transceiver identification codes 260 for the transponder transceivers 104 associated with the corresponding road segment 102. Alternately, in the implementation where the position identification system includes wireless transponding positioning transceivers 200 but does not include wireless GPS positioning transceivers 300, the road segment records need not include GPS location data for the road segment 102, but still includes the transceiver identification codes 260 for the transponder transceivers 104 associated with the corresponding road segments 102. Also, in the variation where the vehicular traffic influencing system 100 includes air quality sensors, each road segment record also identifies the port identifiers of the data transceiver input ports for each air quality sensor associated with the respective road segment 102.

The ROM 406 also includes processing instructions for the CPU which, when loaded into the RAM, establish a memory object defining a traffic congestion parameter monitor 414, a memory object defining a tariff adjuster 416, and a memory object defining tariff notifier 418. Although the traffic congestion parameter monitor 414, the tariff adjuster 416, and the tariff notifier 418 have been described as being memory objects, it should be understood that any or all of them may be implemented instead as a simple sequence of computer processing steps or even in electronic hardware if desired.

The traffic congestion parameter monitor 414 is in communication with the data transceiver 402 and the road segment database 412, and monitors at least one traffic congestion parameter for the roadway to thereby allow the traffic control server 400 to adjust the road tariff for each segment 102 of the roadway in response to changes in traffic congestion. In the implementation where the position identification system comprises a plurality of wireless GPS positioning transceivers 300, the traffic congestion parameter monitor 414 receives GPS transceiver identification codes 350 and location data from the position identification system (via the data transceiver 402), and is configured to determine traffic volume for each road segment 102 from the received GPS transceiver identification codes 350 and the associated location data. To do so, the traffic congestion parameter monitor 414 queries the road segment database 412 with the received GPS location data to identify the road segment 102 upon which each motor vehicle is traveling, and to thereby determine the number of motor vehicles traveling upon each road segment 102. Thereafter, the traffic congestion parameter monitor 414 passes the traffic volume data for each road segment 102 to the tariff adjuster 416 for use in the road tariff calculation (described below).

Alternately, in one variation, the traffic congestion parameter monitor 414 receives the GPS transceiver identification codes 350 and GPS location data from the position identification system, together with time stamp information identifying the time/date the location data was transmitted by the wireless GPS positioning transceivers 300, and is configured to determine average traffic speed for each road segment 102 from the received GPS transceiver identification codes 350, and the associated GPS location data and time stamp data. To do so, the traffic congestion parameter monitor 414 queries the road segment database 412 with the received GPS location data to identify the road segment 102 upon which each motor vehicle is traveling, and based upon the distance each vehicle travels between GPS location readings and the time/date of each reading, the traffic congestion parameter monitor 414 determines the average speed of the motor vehicles traveling along each road segment 102. As above, thereafter the traffic congestion parameter monitor 414 passes the traffic speed data for each road segment 102 to the tariff adjuster 416 for use in the road tariff calculation. As will be appreciated, instead of providing the tariff adjuster 416 with either traffic volume data or traffic speed data, the traffic congestion parameter monitor 414 may be configured instead to pass the tariff adjuster 416 both traffic volume data and traffic speed data for use in the road tariff calculation.

In the implementation where the position identification system comprises a plurality of wireless transponding positioning transceivers 200 and a plurality of wireless transponder transceivers 104, the traffic congestion parameter monitor 414 receives transponder identification codes 250 and associated transceiver identification codes 260 from the position identification system (via the data transceiver 402), and is configured to determine traffic volume for each road segment 102 from the received transponder identification codes 250 and the received transceiver identification codes 260. To do so the traffic congestion parameter monitor 414 queries the road segment database 412 with the received transceiver identification codes 260 to identify the road segment 102 upon which each motor vehicle is traveling, to thereby determine the number of motor vehicles traveling upon each road segment 102. As above, thereafter the traffic congestion parameter monitor 414 passes the traffic volume data (comprising vehicle count and road segment ID) for each road segment 102 to the tariff adjuster 416 for use in the road tariff calculation.

Alternately, in one variation, the traffic congestion parameter monitor 414 receives the transponder identification codes 250 and associated transceiver identification codes 260 from the position identification system, and is configured to determine average traffic speed for each road segment 102 from the received transponder identification codes 250 and associated transceiver identification codes 260. To do so, the traffic congestion parameter monitor 414 queries the road segment database 412 with the received transceiver identification codes 260 to identify the road segment 102 upon which each motor vehicle is traveling, and based upon the arrival time (at the data transceiver 402) of the transceiver identification codes 260 for adjacent wireless transponder transceivers 104 (along a common road segment 102) and the distance between the adjacent wireless transponder transceivers 104, the traffic congestion parameter monitor 414 determines the average speed of the motor vehicles traveling along each road segment 102. As above, thereafter the traffic congestion parameter monitor 414 passes the average speed data (comprising vehicle speed and road segment ID) for each road segment 102 to the tariff adjuster 416 for use in the road tariff calculation. Again, instead of providing the tariff adjuster 416 with either traffic volume data or traffic speed data, the traffic congestion parameter monitor 414 may be configured instead to pass the tariff adjuster 416 both traffic volume data and traffic speed data for use in the road tariff calculation.

As will be apparent, in the implementation where the position identification system includes both wireless transponding positioning transceivers 200 and wireless GPS positioning transceivers 300, the traffic congestion parameter monitor 414 is configured to determine traffic volume from the received GPS location data and the received transceiver identification codes 260. Alternately, or additionally, the traffic congestion parameter monitor 414 may be configured to use the received GPS location data and the received transceiver identification codes 260 to determine average traffic speed. In either case, the traffic congestion parameter monitor 414 passes the traffic volume data, or the traffic speed data, or both, to the tariff adjuster 416 for use in the road tariff calculation.

As discussed above, the vehicular traffic influencing system 100 may include one or more air quality sensors, in which case the data transceiver 402 receives air quality information from the air quality sensors. Accordingly, in this variation, the traffic congestion parameter monitor 414 is configured to determine the air quality for each road segment from the received air quality information and the associated port identifier of the input port upon which the data transceiver 402 received the air quality information. To do so, the traffic congestion parameter monitor 414 queries the road segment database 412 with the transceiver port identifiers to identify the road segments 102 associated with the received air quality information. The traffic congestion parameter monitor 414 then determines the average air quality for each road segment 102 from the air quality information for each road segment 102, and then passes the air quality data (comprising air quality information and road segment ID) for each road segment 102 to the tariff adjuster 416 for use in the road tariff calculation.

The tariff adjuster 416 is in communication with the traffic congestion parameter monitor 414 and the tariff database 410, and is configured to calculate updated road tariffs for each road segment 102 using the monitored traffic congestion parameters, and to update each tariff data record in the tariff database 410 with the corresponding calculated road tariffs. Typically, one of the traffic congestion parameters is traffic volume, and the tariff adjuster 416 calculates the road tariff for each road segment 102 from the traffic volume data received from the traffic congestion parameter monitor 414. Preferably, the tariff adjuster 416 increases the road tariff for a given road segment 102 as the traffic volume for that road segment 102 increases. In this manner, motor vehicle operators will be influenced to use alternate routes in instances of high traffic volume. Conversely, motor vehicle operators will be influenced to use the road segment 102 in instances of low traffic volume.

Alternately, in one variation thereof, one of the traffic congestion parameters is average traffic speed, in which case the tariff adjuster 416 is configured to calculate the road tariff for each road segment 102 from the traffic speed data received from the traffic congestion parameter monitor 414. Preferably, the tariff adjuster 416 increases the road tariff for a given road segment 102 as the traffic speed for that road segment 102 decreases. In this manner, motor vehicle operators will be influenced to use alternate routes in instance of low traffic speed. Conversely, motor vehicle operators will be influenced to use the road segment 102 in instances of high traffic speed. In yet another variation, the tariff adjuster 416 receives both traffic volume data and traffic speed data from the traffic congestion parameter monitor 414, in which case the traffic congestion parameters are traffic volume and traffic speed and the tariff adjuster 416 increases the road tariff for each road segment 102 as the traffic speed on the road segment 102 decreases and the traffic volume on the road segment 102 increases.

Additionally, in the variation where the vehicular traffic influencing system 100 includes air quality sensors, another of the traffic congestion parameters is air quality. In this case, the tariff adjuster 416 is configured to calculate the road tariff for each road segment 102 taking into account the air quality data received from the traffic congestion parameter monitor 414. Preferably, the tariff adjuster 416 is configured to increase the road tariff for a given road segment 102 as the air quality for the road segment 102 decreases. In this manner, motor vehicle operators will be influenced to use alternate routes in instance of poor air quality.

The tariff notifier 418 is in communication with the data transceiver 402, the road segment database 412 and the tariff database 410, and monitors the data transceiver 402 for GPS transceiver identification codes 350 and the associated GPS location data transmitted by the position identification system which indicate that a motor vehicle is approaching the entrance to one of the road segments 102. Alternately, or additionally, the tariff notifier 418 monitors the data transceiver 402 for transponder identification codes 250 and associated transponder transceiver identification codes 260 transmitted by the position identification system which indicate that a motor vehicle is approaching the entrance to one of the road segments 102. To determine whether a motor vehicle is approaching a road segment entrance, the tariff notifier 418 queries the road segment database 412 with the received GPS location data and/or the received transponder transceiver identification codes 260 to identify the location on the roadway for each motor vehicle. If the location of a vehicle within a road segment 102 is proximate to the end of that road segment 102, the tariff notifier 418 concludes that the vehicle is approaching the entrance of an upcoming road segment 102.

After the tariff notifier 418 determines that a motor vehicles has approached a road segment entrance, the tariff notifier 418 provides the vehicle with the road tariff in effect for the road segment 102. To do so, the tariff notifier 418 locates the road segment record(s) for the upcoming road segments 102 using the road segment ID(s) for the adjacent road segments 102, and then locates in the tariff database 410 the tariff data record(s) associated with the identified upcoming road segment(s). After the tariff notifier 418 identifies the road tariffs for the upcoming road segments 102, the tariff notifier 418 creates a data packet which includes the tariff data and either the GPS transceiver identification code 350 or the transponder identification code 250 for the vehicle. The tariff notifier 418 then transmits the data packet wirelessly via the data transceiver 402. The wireless transponding positioning transceiver 200 or the wireless GPS positioning transceiver 300 having an identification code which matches the identification code included in the data packet will recognize the data packet and display the received tariff data on the tariff data output. With the tariff data as a guide, the vehicle operator is then able to make a decision whether to proceed on the current route or to take an alternate route to reach the desired destination.

As discussed above, the traffic control server 400 is in communication with a municipal billing server which issues invoices to motorists for traveling along the roadway. To facilitate billing of motorists, the billing server maintains a database of billing records, each identifying a billing address and/or a billing account for a motor vehicle operator, and the identification code for the wireless transponding positioning transceiver 200 or the wireless GPS positioning transceiver 300 assigned to the motor vehicle operator. The tariff notifier 418 is configured to transmit to the billing server data packets comprising the GPS transceiver identification code 350 or the transponder identification code 250 for the vehicle, the road segment ID for the road segment 102 traveled by the vehicle, and the tariff in effect for the road segment 102 at the time of travel. With the information contained in the transmitted data packets, the billing server is then able to invoice the vehicle operator for the use of the roadway or, if the operator has established a billing account with the municipality, the billing server is able to debit the operator's billing account.

The operation of the vehicular traffic influencing system 100 will now be discussed. As vehicles fitted with a wireless transponding positioning transceiver 200 or a wireless GPS positioning transceiver 300 travel along the roadway, their respective signaling devices 200, 300 provide the traffic control server 400 with information identifying their respective location in real time. The traffic control server 400 continuously monitors this location information (and optionally also monitors the air quality data received from the air quality sensors) since they constitute parameters are associated with the state of traffic congestion at each road segment 102 along the roadway. From this information, the traffic control server 400 continuously calculates road tariffs in real time for the corresponding road segments 102, and stores the calculated road tariff data in the tariff database 410. The tariff calculation algorithm implemented by the traffic control server 400 attempts to dissuade (by increasing road tariffs in real time) the use of road segments 102 having high travel volume, poor air quality and/or low traffic speed. Conversely, the tariff calculation algorithm attempts to encourage (by decreasing road tariffs in real time) the use of road segments 102 having low travel volume, good air quality and/or high traffic speed.

Since the traffic control server 400 continuously monitors the location information provided by the vehicles, the traffic control server 400 is able to determine the location of each vehicle along the roadway. When the traffic control server 400 determines that a vehicle is about to enter or is approaching the next road segment 102, the traffic control server 400 queries the tariff database 410 for the road tariff associated with the next road segment 102. If the vehicle has no choice as to the next possible road segment 102, the traffic control server 400 will only locate the road tariff for the next possible road segment 102. However, if the vehicle is approaching the junction of two or more road segments 102, the traffic control server 400 will locate the road tariff for each route the vehicle could take.

Upon receipt of the road tariff(s) for the next road segment (s) 102, the traffic control server 400 wirelessly transmits, in real time, the road tariff(s) to the wireless transponding positioning transceiver 200 or the wireless GPS positioning transceiver 300 assigned to the vehicle. The vehicle's signaling device 200, 300 provides the vehicle operator with the tariff information, either visually and/or audibly, in real time, thereby allowing the vehicle operator to make a choice whether to continue on the original route or take an alternate route (if an alternate road segment 102 is available). The traffic control server 400 also identifies to the billing server each motor vehicle on the roadway, the road segment 102 each vehicle is traveling one, and the tariff in effect at the time of travel, thereby allowing the billing server to invoice the vehicle operator for the use of the roadway.

The present invention is defined by the claims appended hereto, with the foregoing description being illustrative of a preferred embodiment of the invention. Those of ordinary skill may envisage certain additions, deletions and or modifications to the described embodiment which, although not explicitly suggested herein, nevertheless do not depart from the scope of the invention as defined by the appended claims.

I claim:

1. A method comprising the steps of:

monitoring at least one traffic congestion parameter of a roadway, the roadway including a plurality of road segments each having a respective road tariff and a respective air quality sensor, the congestion parameter comprising air quality, and the monitoring step comprising a traffic control server periodically receiving air quality measurements for each said road segment from the air quality sensors;

the traffic control server dynamically adjusting the road tariff for one of the plurality of road segments in accordance with the associated air quality measurement wherein the adjusting comprises increasing the road tariff for the one road segment in accordance with a decrease in the associated air quality, thus yielding an adjusted road tariff;

the traffic control server receiving from a wireless positioning transceiver associated with a vehicle traveling on the roadway an indication of a current position thereof; and based on the received current position indication, the traffic control server transmitting to the wireless positioning transceiver the adjusted road tariff as the vehicle approaches the one road segment, the wireless positioning transceiver including one of a display and a speaker for providing a notification of the adjusted road tariff as the vehicle approaches the one road segment.

2. The method according to claim 1, wherein the monitoring step comprises determining traffic volume for one road segment, an wherein the adjusting comprises calculating the road tariff for the one road segment from the associated determined traffic volume and the associated air quality measurement, the road tariff calculating comprising dynamically increasing the road tariff for the one road segment in accordance with an increase in the associated traffic volume.

3. A vehicular traffic control server comprising:

monitoring means configured to monitor at least one traffic congestion parameter of a roadway, the roadway including a plurality of road segments each having a respective road tariff and a respective air quality sensor, one of the congestion parameters comprising air quality, the monitoring means being configured to periodically receive from the air quality sensors measurements of the air quality for each said road segment;

tariff adjusting means in communication with the monitoring means for dynamically adjusting the road tariff for one of the road segments in accordance with the associated air quality measurement, the tariff adjusting means being configured to dynamically adjust the road tariff by dynamically increasing the road tariff for the one road segment in accordance with a decrease in the associated air quality, thus yielding an adjusted road tariff; and notifying means in communication with the tariff adjusting means and being configured to receive from a wireless positioning transceiver associated with a vehicle traveling on the roadway an indication of a current position thereof and, based on the received current position indication, to transmit to the wireless positioning transceiver the adjusted road tariff as the vehicle approaches the one road segment.

4. The control server according to claim 3, wherein another one of the congestion parameters comprises traffic volume, the monitoring means is configured to determine the traffic volume for the one road segment, and the tariff adjusting means is further configured to dynamically increase the road tariff for the one road segment in accordance with an increase in the associated traffic volume.

5. The control server according to claim 4, wherein the tariff adjusting means comprises a tariff database of tariff data records, each said tariff data record being associated with a respective road segment and identifying the associated adjusted road tariff, and the tariff adjusting means is configured to update each said tariff data record with the associated calculated road tariff.

6. The control server according to claim 3, wherein the wireless positioning transceiver includes a user interface configured for providing a user indication of the adjusted road tariff.

7. A method comprising the steps of:

monitoring at least one traffic congestion parameter of a roadway, the roadway including a plurality of road segments each having a respective road tariff, the monitoring step comprising a traffic control server periodically receiving congestion indications for each said road segment;

the traffic control server dynamically adjusting the road tariff for one of the plurality of road segments in accordance with the associated congestion indication when the adjusting comprises increasing the road tariff for the one road segment in accordance with an increase in the associated traffic congestion, thus yielding an adjusted road tariff;

the traffic control server receiving from a wireless positioning transceiver associated with a vehicle traveling on the roadway an indication of a current position thereof; and based on the received current position indication, the traffic control server transmitting to the wireless positioning transceiver the adjusted road tariff as the vehicle approaches the one road segment, the wireless positioning transceiver including one of a display and a speaker for providing a notification of the adjusted road tariff as the vehicle approaches the one road segment.

8. The method according to claim 7, wherein the congestion indication comprises traffic volume, the monitoring step comprises determining the traffic volume for the one road segment, and the tariff adjusting step comprises calculating the road tariff for the one road segment from the associated determined traffic volume, the road tariff calculating comprising dynamically increasing the road tariff for each said road segment in accordance with an increase in the associated traffic volume.

9. A vehicular traffic control server comprising:

monitoring means configured to monitor at least one traffic congestion parameter of a roadway, the roadway including a plurality of road segments each having a respective road tariff, the monitoring means being configured to periodically receive data representing the traffic congestion for each said road segment;

tariff adjusting means in communication with the monitoring means for dynamically adjusting the road tariff for one of the road segments in accordance with the associated traffic congestion data, the tariff adjusting means being configured to dynamically increase the road tariff for the one road segment in accordance with an increase in the associated traffic congestion, thus yielding an adjusted road tariff; and notifying means in communication with the tariff adjusting means and being configured to receive from a wireless positioning transceiver associated with a vehicle traveling on the roadway an indication of a current position thereof and, based on the received current position indication, to transmit to the wireless positioning transceiver the adjusted road tariff as the vehicle approaches the one road segment.

10. The control server according to claim 9, wherein the at least one parameter comprises traffic volume, the monitoring means is configured to determine the traffic volume for the one road segment, and the tariff adjusting means is further configured to dynamically increase the road tariff for the one road segment in accordance with an increase in the associated traffic volume.

* * * * *